US005685779A

United States Patent [19]

Tsoukalas

[11] Patent Number: 5,685,779

[45] Date of Patent: Nov. 11, 1997

[54] ELECTRONIC SCOREBOARD DEVICE

[76] Inventor: Savvas C. Tsoukalas, 4506 Chatterton Way, Victoria, British Columbia, Canada, V8X 4Y6

[21] Appl. No.: 632,007

[22] Filed: Apr. 15, 1996

[51] Int. Cl.[6] ..... A63D 15/20

[52] U.S. Cl. ..... 473/1

[58] Field of Search ..... 273/DIG. 26; 473/1

[56] References Cited

U.S. PATENT DOCUMENTS

| | | | |
|---|---|---|---|
| 128,855 | 7/1872 | Collender | 473/1 |
| 1,051,523 | 1/1913 | Stewart | 473/1 |
| 1,205,596 | 11/1916 | David | 473/1 |
| 4,840,376 | 6/1989 | Garret | 473/1 |
| 5,026,053 | 6/1991 | Paterson et al. | 473/1 |
| 5,071,121 | 12/1991 | Garret | 473/1 |

FOREIGN PATENT DOCUMENTS

| | | | |
|---|---|---|---|
| 2186491 | 8/1987 | United Kingdom | 273/DIG. 26 |

*Primary Examiner*—Mark S. Graham

[57] ABSTRACT

An electronic scoreboard device including a housing comprising a scorekeeping display adapted for billiards. The housing has circuitry therein for control of the scorekeeping display. One of two side walls of the housing has a power switch disposed thereon for selectively activating or deactivating the scorekeeping display. The scorekeeping display adds or subtracts from scores automatically to display a player's scores thereon.

1 Claim, 3 Drawing Sheets

ELECTRONIC SCOREBOARD DEVICE

BACKGROUND OF THE INVENTION

1. Field of the Invention

The present invention relates to an electronic scoreboard device and more particularly pertains to keeping score of straight pool and snooker pool games with an electronic scoreboard device.

2. Description of the Prior Art

The use of scoring devices is known in the prior art. More specifically, scoring devices heretofore devised and utilized for the purpose of maintaining scores for games are known to consist basically of familiar, expected and obvious structural configurations, notwithstanding the myriad of designs .encompassed by the crowded prior art which have been developed for the fulfillment of countless objectives and requirements.

By way of example, U.S. Pat. No. 5,071,121 to Garret discloses a game score computing device.

U.S. Pat. No. 4,840,376 to Garret discloses a poker and pool apparatus.

U.S. Pat. No. 3,468,535 to Obst discloses a scoring device.

U.S. Pat. No. 4,171,807 to Lamlee discloses a billiard game.

U.S. Pat. No. 3,683,357 to Presnick et al. discloses a battery operated scoreboard.

U.S. Pat. No. 3,958,804 to Godfrey discloses a billiard game table.

While these devices fulfill their respective, particular objective and requirements, the aforementioned patents do not describe an electronic scoreboard device for keeping score of straight pool and snooker pool games.

In this respect, the electronic scoreboard device according to the present invention substantially departs from the conventional concepts and designs of the prior art, and in doing so provides an apparatus primarily developed for the purpose of keeping score of straight pool and snooker pool games.

Therefore, it can be appreciated that there exists a continuing need for new and improved electronic scoreboard device which can be used for keeping score of straight pool and snooker pool games. In this regard, the present invention substantially fulfills this need.

SUMMARY OF THE INVENTION

In the view of the foregoing disadvantages inherent in the known types of scoring devices now present in the prior art, the present invention provides an improved electronic scoreboard device. As such, the general purpose of the present invention, which will be described subsequently in greater detail, is to provide a new and improved electronic scoreboard device and method which has all the advantages of the prior art and none of the disadvantages.

To attain this, the present invention essentially comprises a housing having a generally rectangular configuration. The housing has a top wall, a bottom wall, a front wall, a rear wall and two side walls. The top wall has an elongated recess formed therein. The front wall comprises a scorekeeping display. The scorekeeping display indicates a plurality of player's scores, games won by each player and a predetermined race to amount. The scorekeeping display also including a game reset button, a reset button, a game selection button, an enter button, buttons corresponding to billiard balls and a help screen. The housing has means therein for control of the scorekeeping display. One of the side walls has a power switch disposed thereon for selectively activating or deactivating the scorekeeping display. The front wall has a chalkboard disposed thereon. A lower end of the chalkboard has a shelf extending outwardly therefrom. The housing has a pair of mounting bosses extending outwardly from upper and lower ends of the rear wall. Each of the mounting bosses has an aperture therethrough for securement of the housing to a recipient surface. A cue stick holder is secured to one of the side walls of the housing. The cue stick holder is comprised of a boss extending outwardly from the side wall. The boss has a plurality of apertures therethrough. The apertures are of a diameter less than a diameter of a handle portion of a pool cue. A billiard rules display is secured to the bottom wall of the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electronic scoreboard device which has all the advantages of the prior art scoring devices and none of the disadvantages.

It is another object of the present invention to provide a new and improved electronic scoreboard device which may be easily and efficiently manufactured and marketed.

It is a further object of the present invention to provide a new and improved electronic scoreboard device which is of durable and reliable construction.

An even further object of the present invention is to provide a new and improved electronic scoreboard device which is susceptible of a low cost of manufacture with regard to both materials and labor, and which accordingly is then susceptible of low prices of sale to the consuming public, thereby making such an electronic scoreboard device economically available to the buying public.

Still yet another object of the present invention is to provide a new and improved electronic scoreboard device which provides in the apparatuses and methods of the prior art some of the advantages thereof, while simultaneously overcoming some of the disadvantages normally associated therewith.

Even still another object of the present invention is to provide a new and improved electronic scoreboard device for keeping score of straight pool and snooker pool games.

Lastly, it is an object of the present invention to provide a new and improved electronic scoreboard device including a housing comprising a scorekeeping display adapted for billiards. The housing has circuitry therein for control of the scorekeeping display. One of two side walls of the housing has a power switch disposed thereon for selectively activating or deactivating the scorekeeping display. The scorekeeping display adds or subtracts from scores automatically to display a player's scores thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
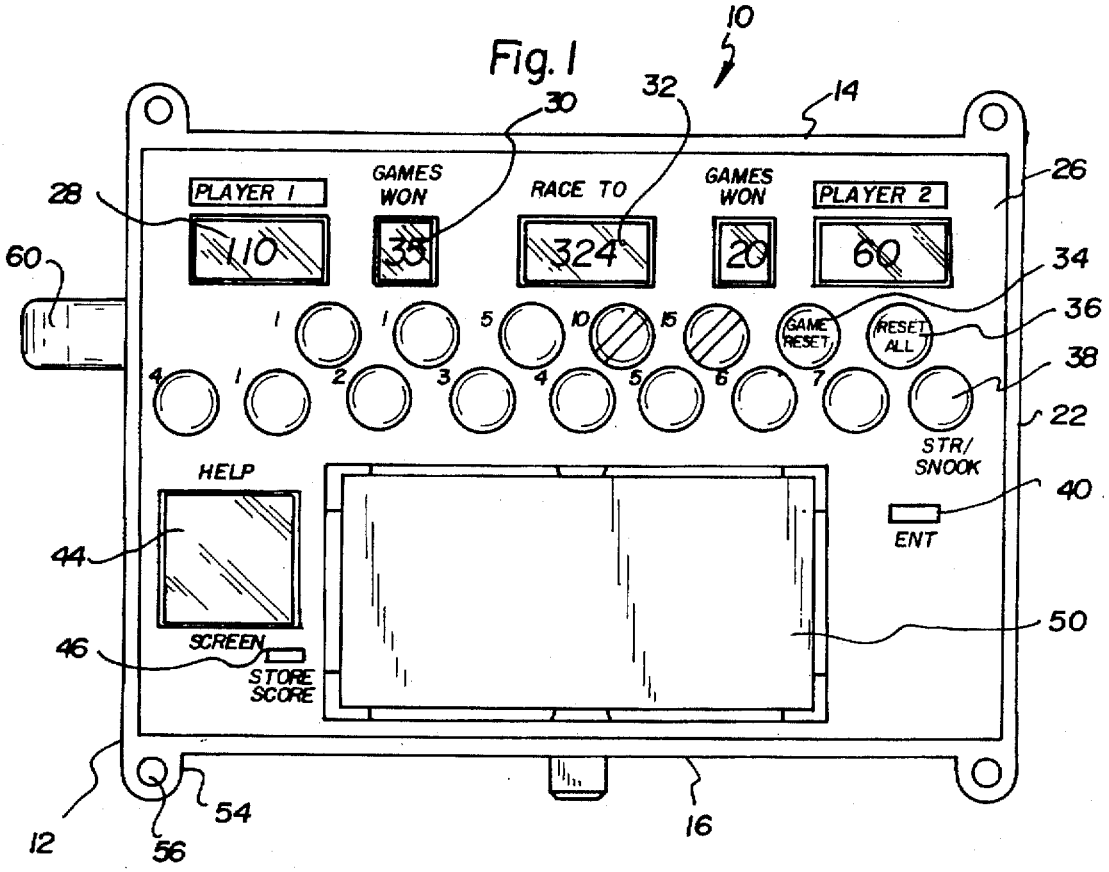
FIG. 1 is a front view of the preferred embodiment of the electronic scoreboard device constructed in accordance with the principles of the present invention.
Figure 2:
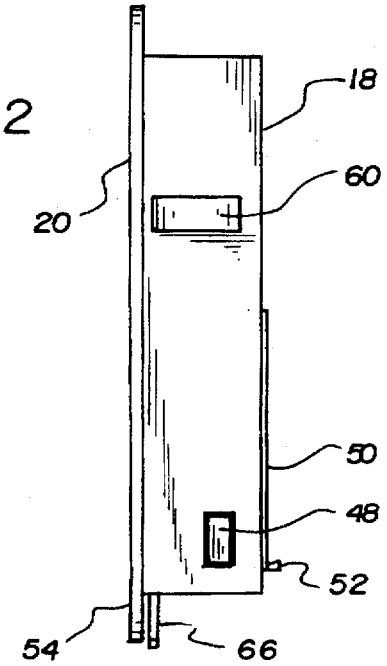
FIG. 2 is a side elevation view of the present invention.
Figure 3:
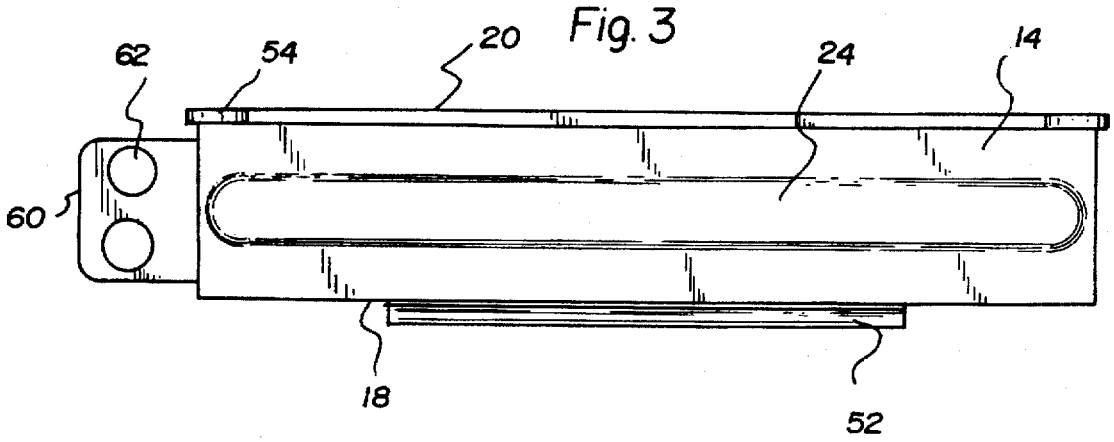
FIG. 3 is a plan view of the preferred embodiment of the present invention.
Figure 4:
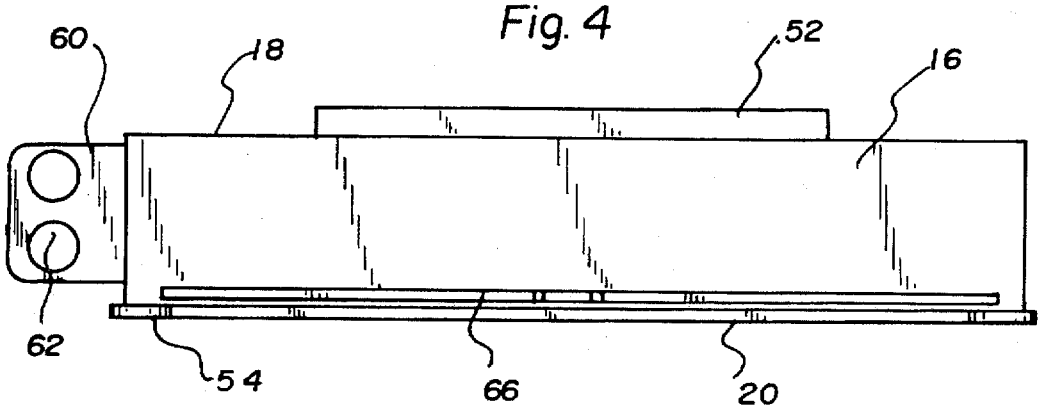
FIG. 4 is a bottom view of the preferred embodiment of the present invention.
Figure 5:
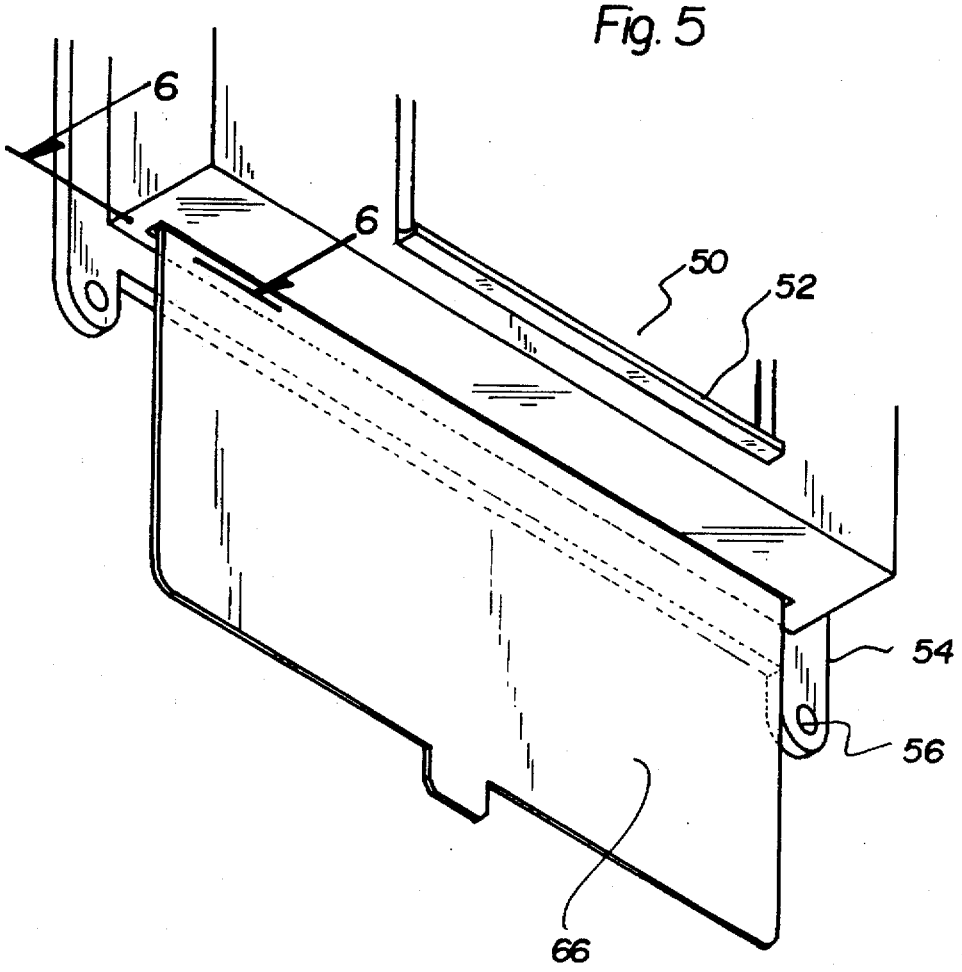
FIG. 5 is a bottom perspective view of the present invention.
Figure 6:
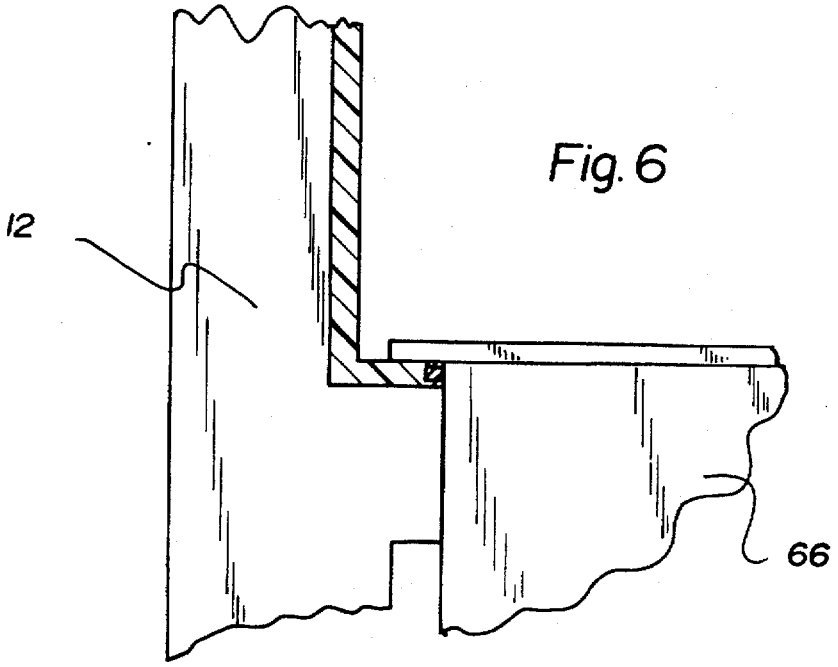
FIG. 6 is a cross-sectional view as taken along line 6—6 of FIG. 5.

With reference now to the drawings, and in particular, to FIGS. 1–6 thereof, the preferred embodiment of the new and improved electronic scoreboard device embodying the principles and concepts of the present invention and generally designated by the reference number 10 will be described.

Specifically, it will be noted in the various Figures that the device relates to a new and improved electronic scoreboard device for keeping score of straight pool and snooker pool games. In its broadest context, the device consists of a housing, a cue stick holder and a billiard rules display. Such components are individually configured and correlated with respect to each other so as to attain the desired objective.

The device 10 includes a housing 12 having a generally rectangular configuration. The housing 12 has a top wall 14, a bottom wall 16, a front wall 18, a rear wall 20 and two side walls 22. The housing 12 is preferably constructed in the dimensions of an actual standard billiard table, with an approximate height of one foot and a width of two feet. The top wall 14 has an elongated recess 24 formed therein. The elongated recess 24 is preferably concave in geometry whereby billiard balls stored therein will gather in a central portion thereof. The front wall 18 comprises a scorekeeping display 26. The scorekeeping display 26 indicates a plurality of player's scores 28, games won by each player 30 and a predetermined race to amount 32. The scorekeeping display 26 also including a game reset button 34, a reset button 36, a game selection button 38, an enter button 40, buttons corresponding to billiard balls 42 and a help screen 44. Additionally, a store score button 46 is provided. The buttons corresponding to billiard balls 42 are disposed in two rows. A top row is used when playing straight pool and a bottom row is used when playing snooker. The balls 42 used for straight pool are colored and will enter numerical scores as follows: white (minus one point), muted yellow (one point), orange (five points), blue stripe (ten points) and burgundy (fifteen points). The balls used for snooker are colored and will enter numerical scores as follows: white (miss or foul, minus four points), red (one point), bright yellow (two points), green (three points), brown (four points), blue (five points), pink (six points) and black (seven points). The housing 12 has means therein for control of the scorekeeping display 26. One of the side walls 22 has a power switch 48 disposed thereon for selectively activating or deactivating the scorekeeping display 26. The device 10 could be constructed to be AC or battery powered. The front wall 18 has a chalkboard 50 disposed thereon. A lower end of the chalkboard 50 has a shelf 52 extending outwardly therefrom. The shelf 52 is dimensioned to hold chalk thereon for writing on the chalkboard 50. The housing 12 has a pair of mounting bosses 54 extending outwardly from upper and lower ends of the rear wall 20. Each of the mounting bosses 54 has an aperture 56 therethrough for securement of the housing 12 to a recipient surface, such as a wall adjacent to a billiard table.

The game reset button 34 is used to start a new game. Pressing this will also toggle up the game won by each player 32 total for the player with the winning score. The game reset button 36, when pressed, will begin an entirely new competition. The predetermined race to amount 32 can be set to display the agreed upon score or number of games to "race to".

In use, one of the player's presses the game reset button 36. The game is selected, using the game selection button 38. The predetermined race to amount 32 is determined and entered. After each player shoots, he pushes the buttons that correspond to his shot, then presses the enter button 40. The scores add or subtract automatically, and the result is displayed in the player's score 28.

The device 10 can record and store one hundred names and high scores. Press the store score button 46 to display in the help screen 44 instructions for entering the player name and for storing the winning score. The winning score will then entered along with the thusly store name, and put in its proper place in a "Top 50" listing. The listing will display in the help screen 44—switching between straight pool and snooker—when the display 26 has been inactive for a set length of time.

A cue stick holder 60 is secured to one of the side walls 22 of the housing 12. The cue stick holder 60 is comprised of a boss extending outwardly from the side wall 22. The boss has a plurality of apertures 62 therethrough. The apertures 62 are of a diameter less than a diameter of a handle portion of a pool cue. This allows the pool cue to slide into the apertures 62 with the wider handle portion of the pool cue abutting the aperture 62 thereby supporting the cue therein.

A billiard rules display 66 is secured to the bottom wall 16 of the housing 12. The billiard rules display 66 will provide the pool player's a list of the rules for playing straight pool and snooker.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An electronic scoreboard device for keeping score of straight pool and snooker pool games comprising, in combination:

a housing having a generally rectangular configuration, the housing having a top wall, a bottom wall, a front wall, a rear wall and two side walls, the top wall having an elongated recess formed therein, the front wall comprising a scorekeeping display, the scorekeeping display indicating a plurality of player's scores, games won by each player, a predetermined race to amount, a game reset, a reset button, a game selection button, an enter button, buttons corresponding to billiard balls and a help screen, the housing having means therein for control of the scorekeeping display, one of the side walls having a power switch disposed thereon for selectively activating or deactivating the scorekeeping display, the front wall having a chalkboard disposed thereon, a lower end of the chalkboard having a shelf extending outwardly therefrom, the housing having a pair of mounting bosses extending outwardly from upper and lower ends of the rear wall, each of the mounting bosses having an aperture therethrough for securement of the housing to a recipient surface;

a cue stick holder secured to one of the side walls of the housing, the cue stick holder comprising a boss extending outwardly from the side wall, the boss having a plurality of apertures therethrough, the apertures being of a diameter less than a diameter of a handle portion of a pool cue;

a billiard rules display secured to the bottom wall of the housing.

* * * * *